US010948267B2

(12) United States Patent
Zimmer

(10) Patent No.: US 10,948,267 B2
(45) **Date of Patent: *Mar. 16, 2021**

(54) OPTICAL SIGHT MOUNTING SYSTEM

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 7 days.

This patent is subject to a terminal disclaimer.

(21) Appl. No.: 16/441,463

(22) Filed: Jun. 14, 2019

(65) Prior Publication Data

US 2019/0331461 A1 Oct. 31, 2019

Related U.S. Application Data

(63) Continuation-in-part of application No. 16/280,087, filed on Feb. 20, 2019, now Pat. No. 10,782,099.

(60) Provisional application No. 62/632,458, filed on Feb. 20, 2018.

(51) Int. Cl.
*F41G 11/00* (2006.01)
*F41G 1/17* (2006.01)

(52) U.S. Cl.
CPC ..... *F41G 11/003* (2013.01); *F41G 1/17* (2013.01); *F41G 11/002* (2013.01)

(58) Field of Classification Search
CPC .... F41G 11/001; F41G 11/002; F41G 11/003; F41G 11/006; F41G 1/30; F41G 1/16; F41C 3/00; Y10T 29/49826
USPC ..... 42/113, 111, 118, 131; 29/428
See application file for complete search history.

(56) References Cited

U.S. PATENT DOCUMENTS 4,021,954 A * 5/1977 Crawford ..... F41G 11/003 42/127
4,934,085 A * 6/1990 Lough ..... F41G 11/003 42/124
6,327,806 B1 12/2001 Paige
7,367,152 B2 5/2008 Samson
7,730,655 B2 6/2010 Spuhr
7,908,782 B1 3/2011 LaRue
7,946,074 B2 5/2011 Nemec
(Continued)

OTHER PUBLICATIONS

Mr. Grouchy (John), mini-RDS going mainstream with the FNP 45 Tactical [online], [dated Oct. 28, 2010], [retrieved on Jun. 10, 2016], Retrieved from the internet: <URL: http://www.mrgrouchy.com/2010/10/28/mini-rds-going-mainstream-with-the-fnp-45-tactical/>.
(Continued)

*Primary Examiner* — Michael D David
(74) *Attorney, Agent, or Firm* — Asgaard Patent Services, LLC; F. Wayne Thompson, Jr.

(57) ABSTRACT

An example optical sight mounting system comprises an optical sight having a base that can be secured to an adapter interface of a pistol slide. The base of the optical sight is configured to that it can be rotated into position within the adapter interface of the pistol slide. In this way, the optical sight can be mounted on a pistol and used to aim. Another example optical sight mounting system comprises an optical sight having a base that can be secured to an adapter interface of an optical sight mount. The base of the optical sight is configured so that it can be rotated into position within the adapter interface of the optical sight mount. The optical sight mount is configured to releasable engage a mounting interface of a firearm (e.g., a MIL-STD-1913 rail). In this way, the optical sight can be positioned on a firearm (e.g., a rifle) and used to aim.

44 Claims, 16 Drawing Sheets

(56) References Cited

U.S. PATENT DOCUMENTS

| | | | | |
|---|---|---|---|---|
| 8,424,234 | B2 | 4/2013 | Carlson | |
| 8,510,983 | B2 | 8/2013 | LaRue | |
| 8,578,647 | B2 | 11/2013 | Storch et al. | |
| 8,769,859 | B2 | 7/2014 | Li et al. | |
| 8,832,983 | B1 | 9/2014 | Wolf | |
| 9,062,936 | B2 | 6/2015 | Zimmer | |
| 9,410,770 | B2 | 8/2016 | Zimmer | |
| 9,696,114 | B1 * | 7/2017 | Cabrera | F41G 1/17 |
| 2005/0057808 | A1 | 3/2005 | Houde-Walter | |
| 2007/0234625 | A1 | 10/2007 | Kidd | |
| 2008/0062487 | A1 | 3/2008 | Houde-Walter | |
| 2008/0092421 | A1 | 4/2008 | Beckmann | |
| 2011/0296732 | A1 | 12/2011 | Carlson et al. | |
| 2013/0160345 | A1 | 6/2013 | Li et al. | |
| 2013/0219767 | A1 | 8/2013 | Peterson et al. | |
| 2013/0283660 | A1 | 10/2013 | Matthews et al. | |
| 2014/0109456 | A1 | 4/2014 | Jung et al. | |
| 2014/0137457 | A1 | 5/2014 | Collin et al. | |
| 2014/0150325 | A1 | 6/2014 | Keng et al. | |
| 2014/0230305 | A1 | 8/2014 | Zimmer | |
| 2014/0298703 | A1 * | 10/2014 | Gale | F41C 27/00 42/71.02 |
| 2015/0276350 | A1 | 10/2015 | Zimmer | |
| 2017/0059277 | A1 * | 3/2017 | Justice | F41G 11/003 |
| 2019/0041162 | A1 * | 2/2019 | Cabrera | F41G 1/10 |
| 2019/0257620 | A1 * | 8/2019 | Zimmer | F41G 11/001 |
| 2019/0331461 | A1 * | 10/2019 | Zimmer | F41G 11/003 |

OTHER PUBLICATIONS

Jeff Compoc, FNH USA's FNP-45 Tactical [online], [dated Aug. 8, 2010], [retrieved on Jun. 10, 2016], Retrieved rrom the internet: <URL: http://gunblog.com/fnh-tactical-45>.

FNP-45 Tactical [online], [dated Jan. 18, 2010], [retrieved on Jun. 10, 2016], Retrieved from the Internet: <URL: http://soldiersystems.net/tag/fnh-usa/page/3/>.

David Crane, FN FNX-45 Tactical .45 ACP Polymer-Framed Combat/Tactical Pistol with Trijicon RMR (Ruggedized Miniature Reflex) RM02 Mini-Red Dot Optical Sight and Extended Threaded Barrel for Silencer/Sound Suppresor! [online], [dated Jul. 22, 2013], [retrieved on Jun. 10, 2016], Retrieved from the internet: <URL: http://www.defensereview.com/fn-fnx-45-tactical-45-acp-polymer-framed-combattactical-pistol-with-trijicon-rmr-ruggedized-miniature-reflex-rm02-mini-red-dot-optical-sight/>.

Black FNP 45 Tactical [online], [dated Sep. 24, 2010], Retrieved from the internet: <URL: http://www.handgunsmag.com/uncategorized/hg_lipsey_080210wo/>.

Armymedicdad, New FNH Handguns for 2010 [online], [dated Nov. 22, 2009], [retrieved on Jun. 10, 2016], Retrieved from the internet: <URL: https://www.ar15.com/archive/topic.html?b=5&f=53&t=86055>.

Goteron, Red Dot Sights for Handguns—p. 12 [online], Lightfighter Tactical Forum, [dated Jan. 31, 2012 & Feb. 1, 2012], [retrieved on Nov. 28, 2016], Retrieved from the internet: <URL: http://www.lightfighter.net/topic/red-dot-sights-for-handguns?page=12>.

Goteron, Red Dot Sights for Handguns—p. 13 [online], Lightfighter Tactical Forum, [dated Feb. 1, 2012 & Feb. 2, 2012], [retrieved on Nov. 28, 2016], Retrieved from the internet: <URL: http://www.lightfighter.net/topic/red-dot-sights-for-handguns?page=13>.

Goteron, Red Dot Sights for Handguns—p. 14 [online], Lightfighter Tactical Forum, [dated Feb. 5, 2012 & Feb. 7, 2012], [retrieved on Nov. 28, 2016], Retrieved from the internet: <URL: http://www.lightfighter.net/topic/red-dot-sights-for-handguns?page=14>.

* cited by examiner

SECTION A-A

OPTICAL SIGHT MOUNTING SYSTEM

CROSS REFERENCE TO RELATED APPLICATION

This is a continuation-in-part application claiming the benefit of U.S. patent application Ser. No. 16/280,087, filed on Feb. 20, 2019, which claims the benefit of U.S. Provisional Application Ser. No. 62/632,458, which was filed on Feb. 20, 2018, the entireties of both applications are incorporated herein by reference.

TECHNICAL FIELD

This disclosure relates to implementations of an optical sight mounting system. In particular, the present disclosure is directed to an optical sight that includes a base configured to be removably secured to an adapter interface of a pistol slide and, in some implementations, an optical sight mount.

BACKGROUND

The vast majority of pistols come from the factory with iron sights. Typical iron sights provided on a pistol include a front post and a rear notch which must be aligned to aim the pistol. Mounting an optical sight on a pistol offers a shooter several advantages over using iron sights alone. Optical sights provide a simplified sight picture comprised of a single illuminated aiming point in place of the front post and rear notch of iron sights. In this way, a shooter's accuracy and/or speed with a pistol may improve. Further, a shooter may be able to aim with the illuminated aiming point of an optical sight in environmental conditions that would make visual alignment of the iron sights difficult or impossible, low light conditions for example.

However, given the design of most pistols, attaching an optical sight may be difficult to do. In order to accommodate an optical sight, the slide of the pistol may need to be permanently modified in order to mount an optical sight thereon, milled for example. If the user decides to switch to a new optical sight, further modifications to the pistol may be required. In some instances, the pistol may not be suitable for further modification.

Accordingly, it can be seen that needs exist for the optical sight mounting system disclosed herein. It is to the provision of an optical sight mounting system that is configured to address these needs, and others, that the present invention in primarily directed.

SUMMARY OF THE INVENTION

Implementations of an optical sight mounting system are provided. An example optical sight mounting system comprises a pistol slide and an optical sight. The pistol slide includes an adapter interface comprising a bottom surface extending between a first end wall and a second end wall. The adapter interface includes a pivot boss that extends up from the bottom surface thereof. The optical sight includes a base that can be secured to the adapter interface of the pistol slide. The base of the optical sight comprises a pivot bore in an underside thereof, the pivot bore of the base is configured to receive the pivot boss of the adapter interface therein. The base of the optical sight is configured so that it can be rotated into position within the adapter interface of the pistol slide.

Another example optical sight mounting system comprises a pistol slide and an optical sight. The pistol slide includes an adapter interface comprising a bottom surface extending between a first end wall and a second end wall. The adapter interface includes a pivot bore in the bottom surface thereof. The optical sight includes a base that can be secured to the adapter interface of the pistol slide. The base of the optical sight comprises a pivot boss that extends from an underside thereof. The pivot bore of the adapter interface is configured to receive the pivot boss of the base therein. The base of the optical sight is configured so that it can be rotated into position within the adapter interface of the pistol slide.

Yet another example optical sight mounting system comprises an optical sight mount and an optical sight. The optical sight mount comprises a base configured to releasably engage a mounting interface of a firearm, and an adapter interface comprising a bottom surface extending between a first end wall and a second end wall. The adapter interface includes a pivot boss and a rotation stop that are a single unitary piece. The optical sight includes a base that can be secured to the adapter interface of the optical sight mount. The base of the optical sight comprises a guide feature in an underside thereof, the guide feature is configured to interface with the pivot boss and the rotation stop of the adapter interface. The base of the optical sight is configured so that it can be rotated into position within the adapter interface of the optical sight mount.

Still yet another example optical sight mounting system comprises an optical sight mount and an optical sight. The optical sight mount comprises a base configured to releasably engage a mounting interface of a firearm, and an adapter interface comprising a bottom surface extending between a first end wall and a second end wall. The adapter interface includes a guide feature in the bottom surface thereof. The optical sight includes a base that can be secured to the adapter interface of the optical sight mount. The base of the optical sight comprises a pivot boss and a rotation stop that are a single unitary piece extending from an underside thereof. The guide feature of the adapter interface is configured to interface with the pivot boss and the rotation stop of the base of the optical sight. The base of the optical sight is configured so that it can be rotated into position within the adapter interface of the optical sight mount.

An example optical sight provides an aiming point illuminated by electricity, tritium, a light emitting chemical reaction, or a combination thereof. A key feature of the optical sight is the integral base configured to be received by an appropriately configured adapter interface. Therefore, in some implementations, the optical sight can be similar to an Aimpoint® Micro optical sight, a DOCTER® red dot sight, a Leupold® Deltapoint, a Trijicon RMR®, or other optical sight of similar size that is currently known or developed in the future, that includes an integral base configured to interface with the adapter interface of an optical sight mounting system.

BRIEF DESCRIPTION OF THE DRAWINGS

Like reference numerals refer to corresponding parts throughout the several views of the drawings.

DETAILED DESCRIPTION

FIGS. 1A-1D illustrate an example implementation of an adapter plate system 100 for mounting optical sights on a pistol according to the principles of the present disclosure. Through the use of interchangeable adapter plates configured to receive optical sights thereon, a user may change the optical sight mounted on a pistol slide by changing the adapter plate secured to the adapter interface of the pistol slide. In this way, further modification to the pistol slide is not required to accommodate a variety of optical sights.

Figure 1A:
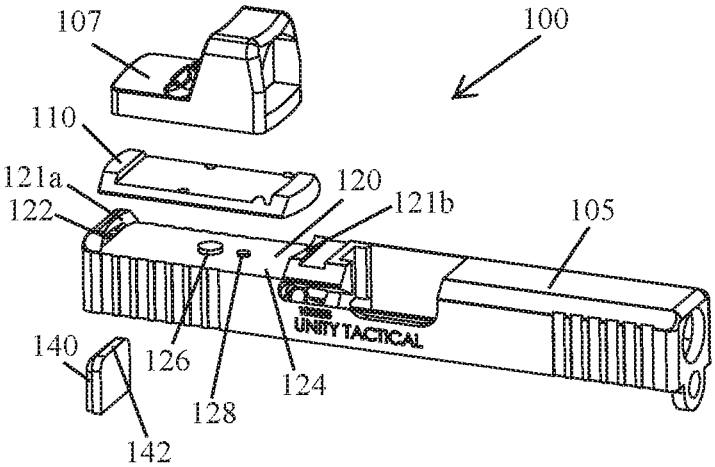
FIGS. 1A-1D illustrate an example adapter plate system for mounting optical sights on a pistol according to the principles of the present disclosure.

As shown in FIG. 1A, in some implementations, the adapter plate system 100 may comprise an adapter plate 110, a pistol slide (e.g., pistol slide 105) having an adapter interface 120 configured to receive the adapter plate 110, and a slide cover plate 140 configured to prevent the adapter plate 110 from rotating. In some implementations, an adapter plate 110 may be configured so that an optical sight (e.g., optical sight 107) can be mounted thereon.

In some implementations, a pistol slide 105 may be manufactured with an adapter interface 120 configured in accordance with the present disclosure. In some implementations, a pistol slide 105 may be machined, or otherwise modified, to have an adapter interface 120 configured in accordance with the present disclosure.

Figure 2A:
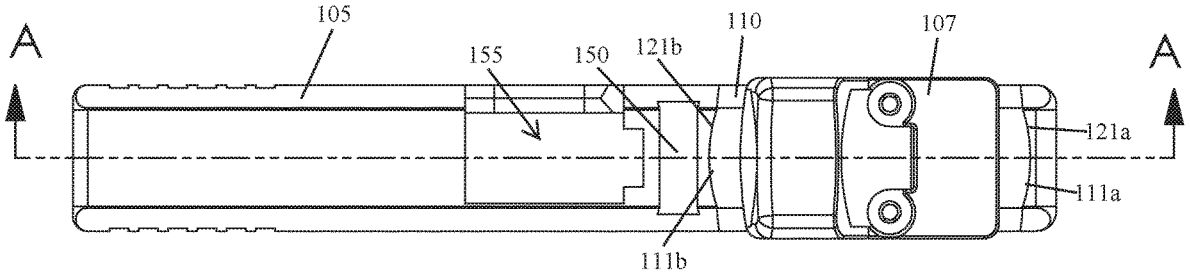
FIG. 2A illustrates a top view of the adapter plate system shown in FIG. 1D, wherein the adapter plate (with an optical sight mounted thereon) is positioned within the adapter interface of the pistol slide.
Figure 2B:
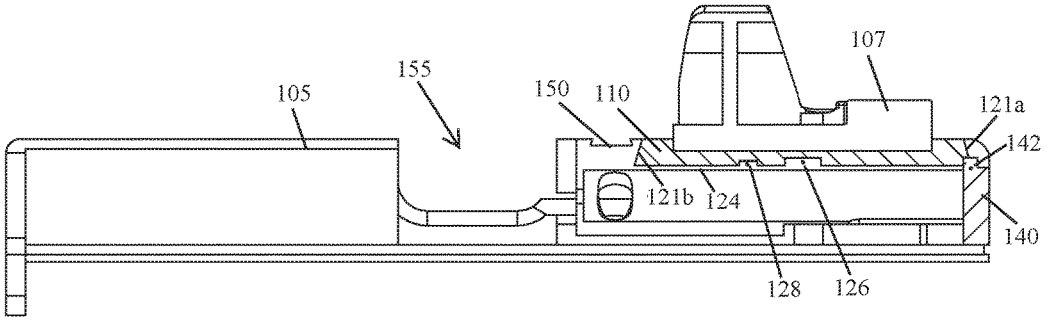
FIG. 2B illustrates a cross-sectional view of the adapter plate system taken along line A-A of FIG. 2A.

As shown in FIGS. 1A and 2B, in some implementations, the adapter interface 120 may comprise a bottom surface 124 having a pivot boss 126 and a rotation stop 128 extending therefrom, the bottom surface 124 extends between a first end wall 121*a* and a second end wall 121*b* (collectively end walls 121).

As shown in FIG. 2B, in some implementations, the bottom surface 124 of the adapter interface 120 is recessed below the top surface of the pistol slide 105. In this way, an optical sight (e.g., optical sight 107) attached to an adapter plate 110 sits lower on the pistol slide 105 than would an optical sight mounted on the top surface of the pistol slide 105. In some implementations, the depth of the bottom surface 124 of the adapter interface 120 may be limited by the amount of material that can be removed and/or omitted without compromising the structural integrity of the pistol slide.

As shown in FIG. 1A, in some implementations, the pivot boss 126 may be a cylindrical structure extending up from the bottom surface 124 of the adapter interface 120. In some implementations, the pivot boss 122 may be a tapered structure extending up from the bottom surface 124 of the adapter interface 120 (not shown). In some implementations, the pivot boss 126 is positioned on the bottom surface 124 of the adapter interface 120 so that it can be received within a pivot bore 112 in the underside of the adapter plate 110 (see, e.g., FIGS. 2B and 3B). In some implementations, the pivot boss 126 may be positioned in the center of the bottom surface 124 of the adapter interface 120 (see, e.g., FIG. 1A). In some implementations, the pivot boss 126 may be positioned at any point on the bottom surface 124 of the adapter interface 120, provided that the pivot bore 112 of the adapter plate 110 is able to receive the pivot boss 126 therein and the adapter plate 110 can be rotated into position within the adapter interface 120. In some implementations, the pivot boss 126 may be configured to prevent an adapter plate 110 from sliding back and forth within the adapter interface 120 due to the incidental vibrations associated with the discharge of a pistol.

As shown in FIG. 1A, in some implementations, the rotation stop 128 may be a cylindrical structure extending up from the bottom surface 124 of the adapter interface 120. In some implementations, the rotation stop 128 is positioned on the bottom surface 124 of the adapter interface 120 so that it can be received within a curved guide channel 114 located in the underside of the adapter plate 110 (see, e.g., FIGS. 2B and 3B). In some implementations, the rotation stop 128 may be positioned at any point on the bottom surface 124 of the adapter interface 120, provided that the guide channel 114 of the adapter plate 110 is able to receive the rotation stop 128 therein and the position of the rotation stop 128 does not prevent the adapter plate 110 from being rotated into position within the adapter interface 120. In some implementations, the rotation stop 128 may be any structure suitably shaped for being operably received within the curved guide channel 117 in the underside of the adapter plate 110.

Figure 1B:
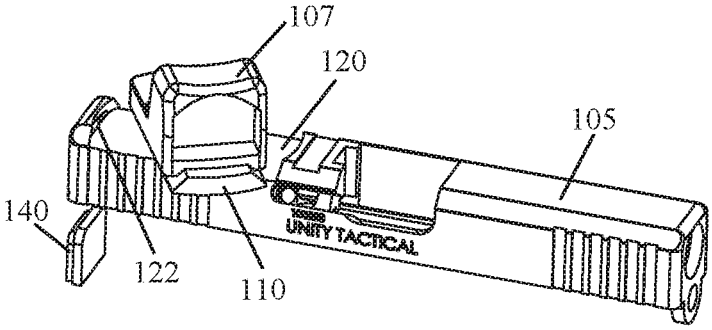
Figure 1C:
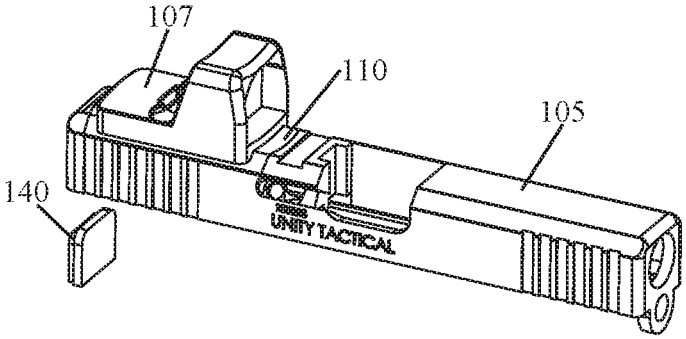

As shown in FIGS. 2A and 2B, in some implementations, the adapter interface 120 of the pistol slide 105 may be configured to receive an adapter plate 110 therein. In some implementations, the end walls 121*a*, 121*b* of the adapter interface 120 may be configured to interface with the curved ends 111*a*, 111*b* of the adapter plate 110. In some implementations, each end wall 121*a*, 121*b* of the adapter interface 120 may be curved along its length and thereby configured so that the adapter plate 110 can be rotated into position within the adapter interface 120 (see, e.g., FIGS. 1B-1C). In some implementations, at least a portion of the first end wall 121*a* and/or the second end wall 121*b* of the adapter interface 120 may extend from the bottom surface 124 at an angle (see, e.g., FIG. 2B). In some implementations, each end wall 121*a*, 121*b* of the adapter interface 120 may be configured to form the female portion of a joint and each end 111*a*, 111*b* of the adapter plate 110 may be configured to form the male portion of a joint (see, e.g., FIGS. 2A and 2B). In this way, a secure connection may be achieved when the adapter plate 110 is rotated into position within the adapter interface 120.

Although not shown, in some implementations, the first end wall 121*a* and the second end wall 121*b* of the adapter interface 120 may each be a groove configured to receive therein the first end 111*a* and the second end 111*b*, respectively, of the adapter plate 110. In some implementations, the adapter interface 120 may be any shape suitable for receiving an adapter plate 110 therein.

As shown in FIG. 1A, in some implementations, the first end wall 121*a* of the adapter interface 120 may include a slot 122 that extends therethrough. In this way, when the slide cover plate 140 is installed on the pistol slide 105, a portion of the slide cover plate 140 extends into the slot 122 and interfaces with the first end 121*a* of the adapter plate 110 (see, e.g., FIG. 2B). In some implementations, the slot 122 of the first end wall 121*a* may be any suitable shape.

Figure 3B:
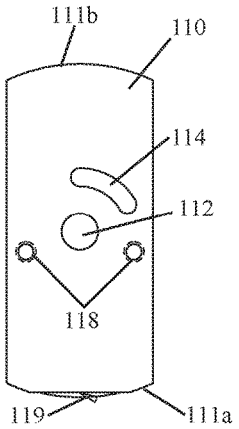
FIGS. 3A and 3B illustrate an example adapter plate according to the principles of the present disclosure.
Figure 3A:
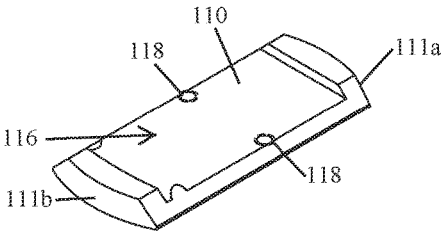

As shown in FIGS. 3A and 3B, in some implementations, the adapter plate 110 may be configured so that it can be rotated into position between the curved end walls 121 of the adapter interface 120. In some implementations, the adapter plate 110 may comprise a top side (see, e.g., FIG. 3A) onto which an optical sight 107 can be mounted and an underside configured to interface with the pivot boss 126 and the rotation stop 128 of the adapter interface 120 (see, e.g., FIG. 3B).

As shown in FIG. 3A, in some implementations, the adapter plate 110 may have the general shape of a rectangle. In some implementations, the top side of the adapter plate 110 includes a mounting surface 116 configured to receive an optical sight 107 thereon. In some implementations, the mounting surface 116 of the adapter plate 110 may be any shape suitable for mounting an optical sight thereon. In some implementations, the adapter plate 110 may include one or more openings 118 therein (see, e.g. FIGS. 3A and 3B). In this way, fasteners (e.g., screws) may be used to secure an optical sight 107 onto the mounting surface 116 of the adapter plate 110. In some implementations, an optical sight may have an aiming point illuminated by electricity, tritium, a light emitting chemical reaction, or a combination thereof. In some implementations, the optical sight may be an Aimpoint® Micro optical sight, a DOCTER® red dot sight, a Leupold® Deltapoint, a Trijicon RMR®, or other optical sight having a similar foot print that is currently known or developed in the future.

In some implementations, the top side of the adapter plate 110 may include a recoil lug thereon. In this way, an attached optical sight may be prevented from sliding back and forth due to the incidental vibrations associated with the discharge of a pistol.

As shown in FIG. 3B, in some implementations, the pivot bore 112 may be a cylindrical shaped opening in the underside of the adapter plate 110. In some implementations, the pivot bore 112 may be any shape suitable for receiving therein, and rotating about, the pivot boss 126. In some implementations, the pivot bore 112 is positioned on the underside of the adapter plate 112 so that it can receive, and pivot on, the pivot boss 126 of the adapter interface 120 (see, e.g., FIG. 2B). In some implementations, the pivot bore 112 may be positioned in, or near, the center of the underside of the adapter plate 110 (see, e.g., FIG. 3B). In some implementations, the pivot bore 112 may be positioned at any point on the underside of the adapter plate 110, provided that the pivot bore 112 of the adapter plate 110 is able to receive the pivot boss 126 therein and the adapter plate 110 can be rotated into position within the adapter interface 120.

As shown in FIG. 3B, in some implementations, the curved guide channel 114 of the adapter plate 110 may be any shape suitable for receiving the rotation stop 128 of the adapter interface 120 therein. In some implementations, the curved guide channel 114 may be configured to limit the rotation of the adapter plate 110 when it is being rotated into position within the adapter interface 120 of a pistol slide 105. In some implementations, the curved guide channel 114 is positioned on the underside of the adapter plate 110 so that the rotation stop 128 is positioned therein during assembly of the adapter plate system 100. In this way, rotation of the adapter plate 110 is limited by the length of the curved guide channel 114.

As shown in FIGS. 2B and 3B, in some implementation the first end 111*a* of the adapter plate 110 may be configured to interface with the portion of the slide cover plate 140 that extends into the slot 122 of the first end wall 121*a* of the adapter interface 120. In this way, the slide cover plate 140 may be used to prevent the adapter plate 110 from rotating while it's positioned in the adapter interface 120. In some implementations, the locking interface 119 on the first end 111*a* of the adapter plate 110 may be a flat surface. In some implementations, the locking interface 119 may be tapered/ramped (not shown). In this way, the adapter plate 110 may be longitudinally centered within the adapter interface 120.

As shown in FIG. 2B, in some implementations, the slide cover plate 140 of the adapter plate system 100 may be configured to interface with the first end 111*a* of the adapter plate 110. In this way, the slide cover plate 140 may be used to prevent the adapter plate 110 from rotating while it is positioned within the adapter interface 120 of the pistol slide 105. In some implementations, the slide cover plate 140 may include a lip 142 thereon, or other similar feature, that interfaces with the first end 111*a* of the adapter plate 110. In some implementations, the slide cover plate 140 may be the same as, or similar to, the slide cover plate of a Glock® pistol, which is well known to those of ordinary skill in the art.

As shown in FIGS. 1A and 1B, in some implementations, the following steps may be use to secure an optical sight 107 to the adapter plate 110.

Initially, as shown in FIG. 1A, the optical sight 107 may be oriented so that the openings 118 in the adapter plate 110 are aligned with openings that extend into, or through, the optical sight 107.

Then, the optical sight 107 is positioned on the mounting surface 116 of the adapter plate 110.

Next, fasteners (e.g., screws) may be used to secure the optical sight 107 to the mounting surface 116 of the adapter plate 110 (see, e.g., FIG. 1B).

To remove the optical sight 107 from the adapter plate 110, the above steps are performed in reverse.

Figure 1D:
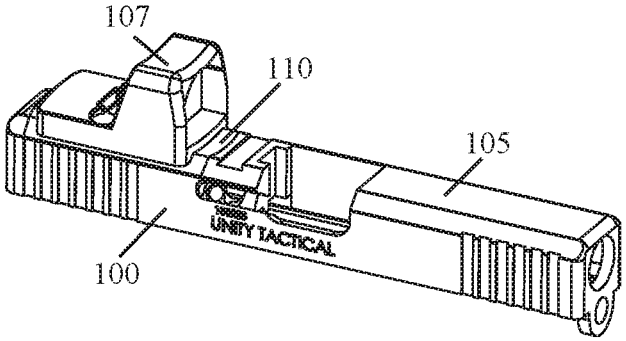

As shown in FIGS. 1B-1D, in some implementations, the following steps may be used to secure the adapter plate 110 to the adapter interface 120 of the pistol slide 105.

Initially, as shown in FIG. 1B, the adapter plate 110 is positioned at an offset angle (e.g., 60 degrees) relative to the longitudinal axis of the pistol slide 105 so that the pivot boss 126 and the rotation stop 128 are received within the pivot bore 112 and the guide channel 114, respectively, in the underside thereof. The degree of offset required to begin installation of the adapter plate 110 is, at least in part, a function of the guide channel's 114 configuration (e.g., length, position, etc).

Then, as shown in FIG. 1B, the adapter plate 110 is rotated about the pivot boss 126 until rotation is stopped by the rotation stop 128. The optical sight 107 will now be aligned with the longitudinal axis of the pistol slide 105 (see, e.g., FIG. 2A).

Next, as shown in FIG. 1D, the slide cover plate 140 is installed on the slide 105, thereby locking the adapter plate 110 into position within the adapter interface 120.

To remove the adapter plate 110 from the adapter interface 120, the above steps are performed in reverse.

In some implementations, the adapter plate 110 may be configured so that one or more fasteners can be inserted through openings (e.g., openings 118) therein, from the underside thereof, and threadedly secured to corresponding openings located in the bottom side of an optical sight. In this way, for example, an optical sight such as an Aimpoint® Micro may be mounted to an adapter plate 110.

As shown in FIG. 2B, in some implementations, a dovetail 150 may be positioned between the ejection port 155 and the adapter interface 120 of the pistol slide 105. In some implementations, the dovetail 150 may be configured to receive a rear sight therein (not shown). In this way, iron sights may be used in conjunction with one or more implementations of the adapter plate system 100 disclosed herein.

In some implementations, an optical sight (e.g., optical sight 107) mounted on an adapter plate 110 of the adapter plate system 100 may sit low enough within the adapter interface 120 that a user is able to align the iron sights of a pistol while looking through the optical sight 107.

Figure 4A:
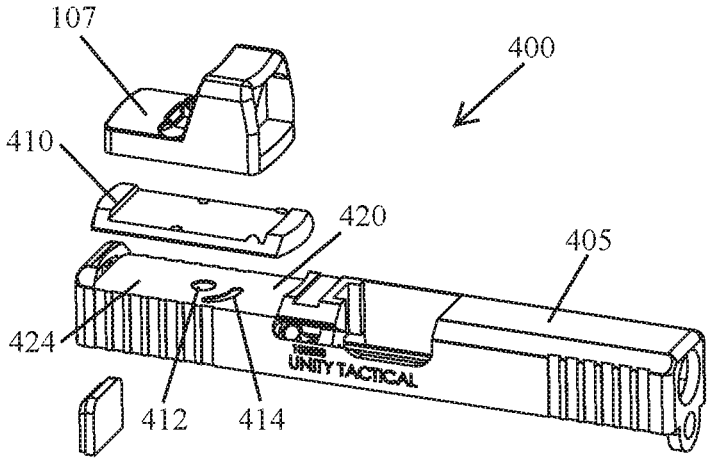
FIGS. 4A and 4B illustrate another example adapter plate system for mounting optical sights on a pistol according to the principles of the present disclosure.
Figure 4B:
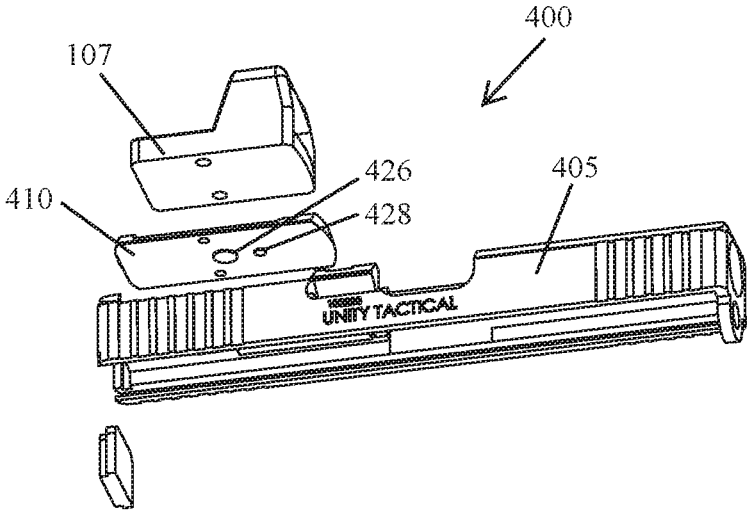

FIGS. 4A and 4B illustrate another example implementation of an adapter plate system 400 according to the principles of the present disclosure. In some implementations, the adapter plate system 400 is similar to the adapter plate system 100 discussed above but the pivot boss 426 and the rotation stop 428 extend from the underside of the adapter plate 410; and the pivot bore 412 and the curved guide channel 414 are located in the bottom surface 424 of the adapter interface 420. In this way, the adapter interface 420 of the pistol slide 405 may be configured to rotatably receive the adapter plate 410 therein.

FIGS. 5A-5D illustrate yet another example implementation of an adapter plate system 500 according to the principles of the present disclosure. In some implementations, the adapter plate system 500 is similar to the adapter plate systems 100, 400 discussed above, in particular the adapter plate system 100 shown in FIGS. 1A-1D and 2A-2B, but further comprises a spring-loaded detent assembly 560 configured to further secure the adapter plate 510 against unintentional rotation once it has been positioned within the adapter interface 520 of the pistol slide 505.

Figure 5A:
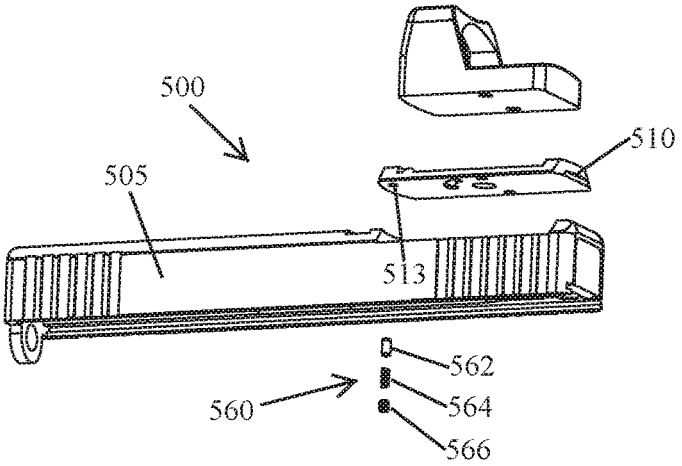
FIGS. 5A-5D illustrate yet another example adapter plate system for mounting optical sights on a pistol according to the principles of the present disclosure.
Figure 5B:
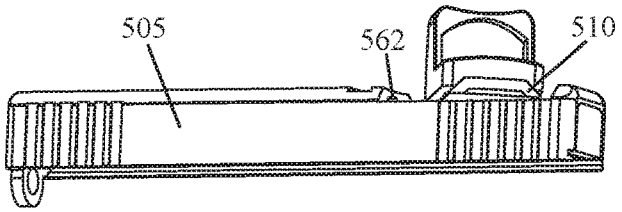
Figure 5C:
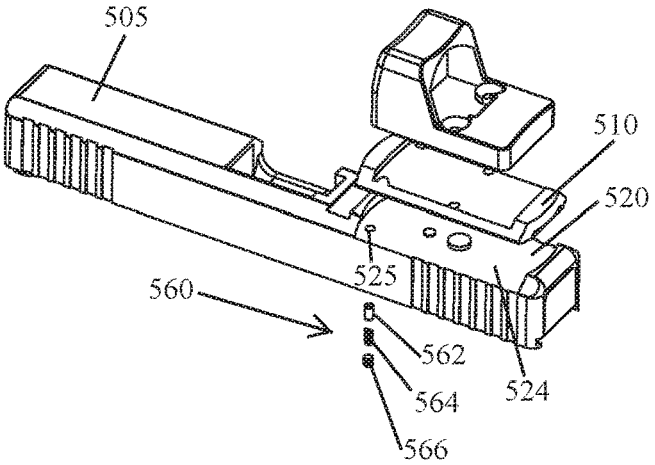
Figure 5D:
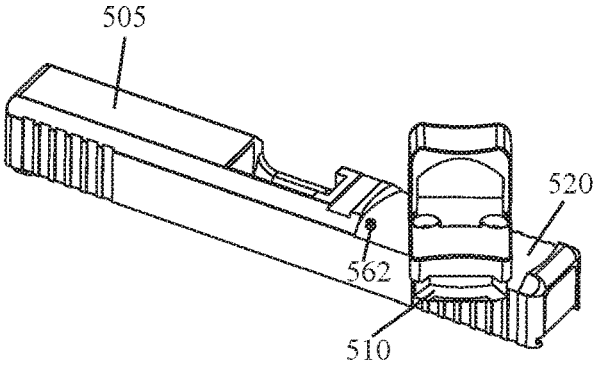

As shown in FIGS. 5A and 5C, in some implementations, the spring-loaded detent assembly 560 comprises a detent 562, a spring 564, and an assembly retainer 566 (e.g., a set screw).

In some implementations, the assembly retainer 566 may be configured to retain the spring 564 and detent 562 within a bore 525 extending through the adapter interface 520 of the pistol slide 505 (see, e.g., FIG. 5C). In this way, the spring 564 may be positioned to bias the detent 562 towards a first end of the bore 525 and thereby cause a portion of the detent 562 to protrude from the first end of the bore 525 (see, e.g., FIGS. 5B and 5D). In some implementations, the bore 525 in the bottom surface 524 of the adapter interface 520 is positioned so that the protruding portion of the detent 562 can be received within a detent catch 513 located in the underside of the adapter plate 510 (see, e.g., FIG. 5A). In this way, the spring-loaded detent assembly 560 may be used to prevent, or minimize, the rotational and/or longitudinal movement of the adapter plate 510 once it has been positioned within the adapter interface 520 of the pistol slide 505.

In some implementations, the detent catch 513 may be a bore in the underside of the adapter plate 510 configured to receive the portion of the detent 562 extending from the first end of the bore 525 in the adapter interface 520. In some implementations, the detent catch 513 in the underside of the adapter plate 510 may be any shape suitable for removably receiving the protruding portion of the detent 562 therein.

In some implementations, an adapter plate system may be configured so that the spring-loaded detent assembly 560 is used to secure the adapter plate 510 within the adapter interface 520 in-lieu of a slide cover plate. In such an implementation, there would be no need to include a locking interface (e.g., locking interface 119) on the first end of the adapter plate (e.g., adapter plate 110) or a slot (e.g., slot 122) that extends through the first end wall of the adapter interface (e.g., adapter interface 120).

In some implementations, an adapter plate system may be configured so that a spring-loaded detent assembly 560 is used in conjunction with a slide cover plate to secure the adapter plate 510 in position within the adapter interface 520.

FIGS. 6A-6D and 7A-7B illustrate still yet another example implementation of an adapter plate system 600 according to the principles of the present disclosure. In some implementations, the adapter plate system 600 is similar to the adapter plate systems 100, 400, 500 discussed above, but the rotation stop 628 has been integrated with the pivot boss 626. Further, in some implementations, the first end 611*a* and/or the second end 611*b* of the adapter plate 610 may include an indexing spring 670 configured to further secure the adapter plate 610 in position within the adapter interface 620 of the pistol slide 605.

Figure 6A:
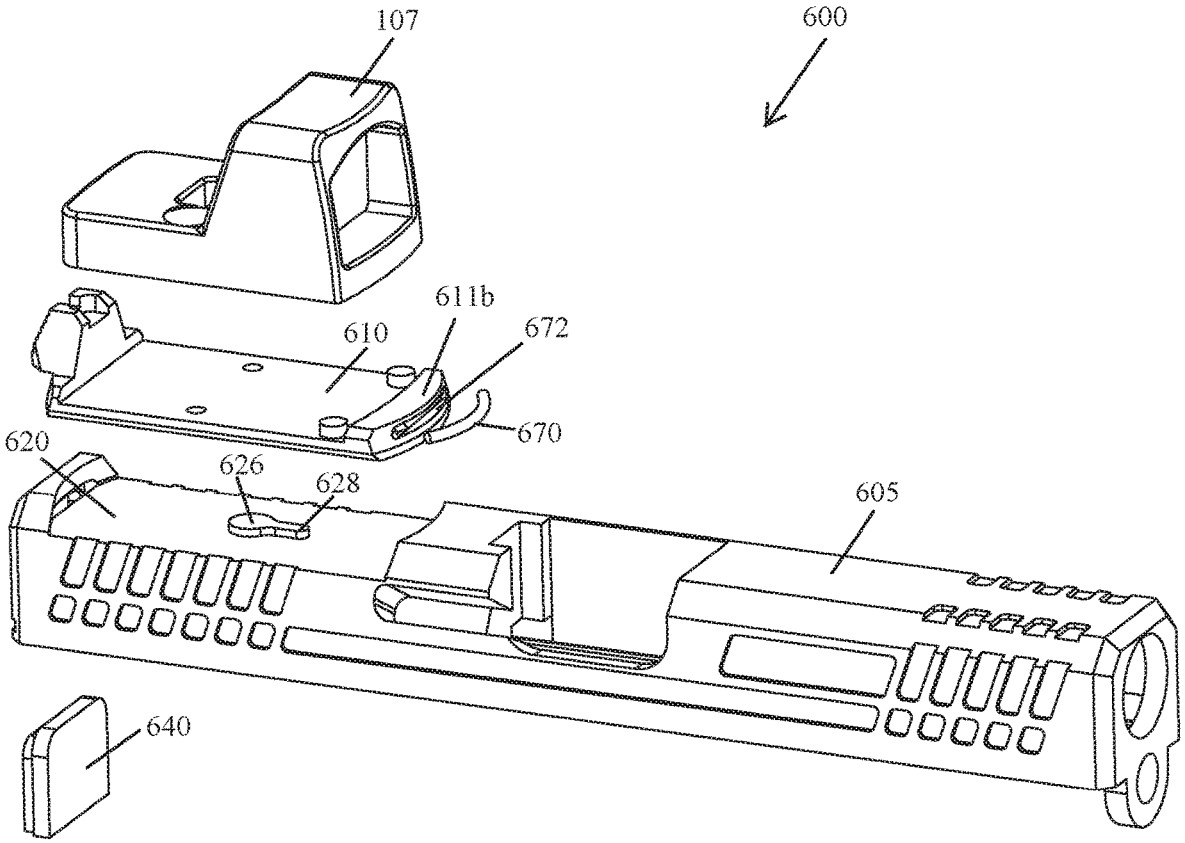
FIG. 6A-6D illustrate still yet another example adapter plate system for mounting optical sights on a pistol according to the principles of the present disclosure.

As shown in FIG. 6A, in some implementations, the pivot boss 626 and the rotation stop 628 extending up from the adapter interface 620 are a single unitary piece configured to be received within a guide feature 630 in the underside of the adapter plate 610. In this way, the adapter plate 610 can rotate about the pivot boss 626 while the rotation stop 628 acts as an indexing feature configured to limit the rotation of the adapter plate 610 when it is being rotated into position within the adapter interface 620 of the pistol slide 605.

Figure 6B:
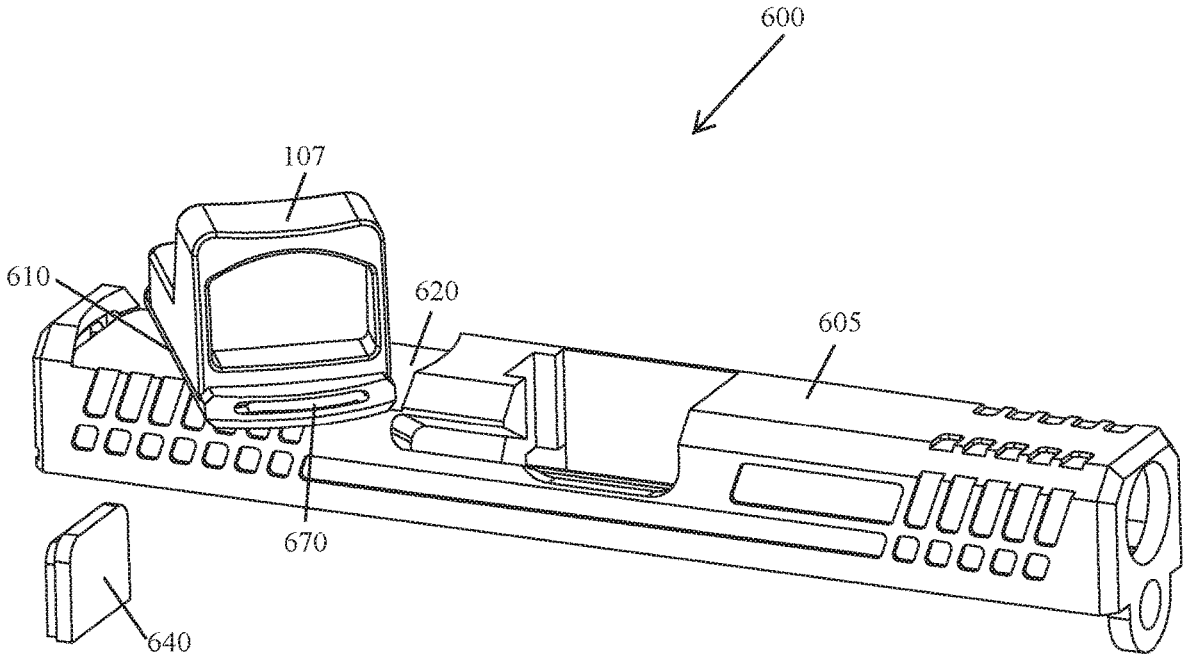
Figure 6C:
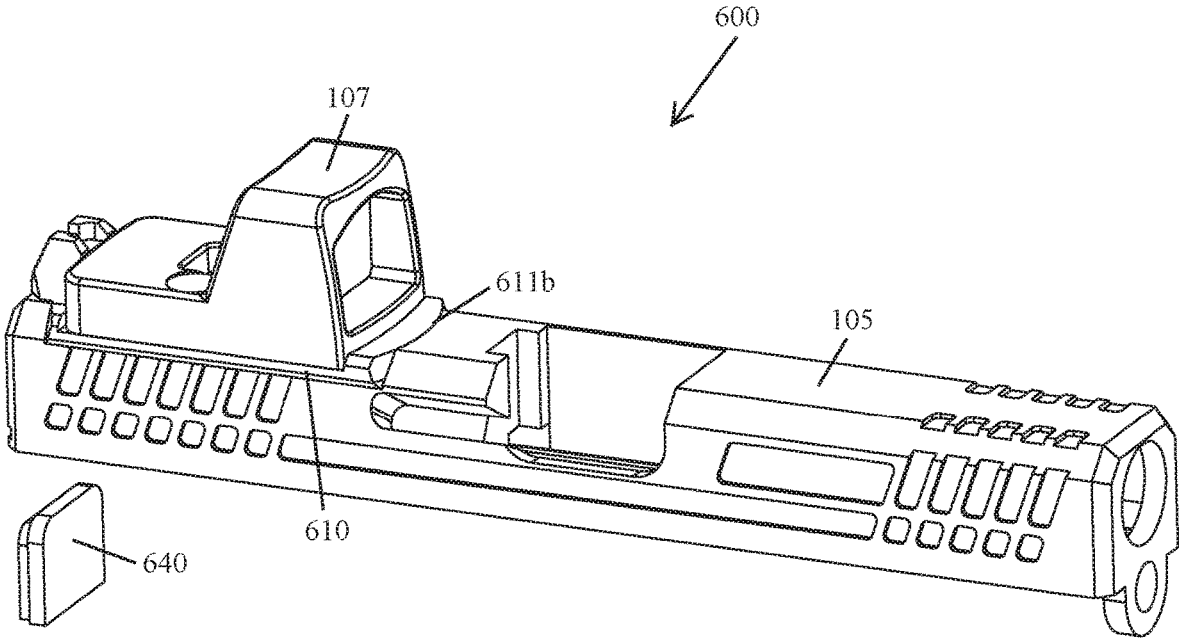
Figure 6D:
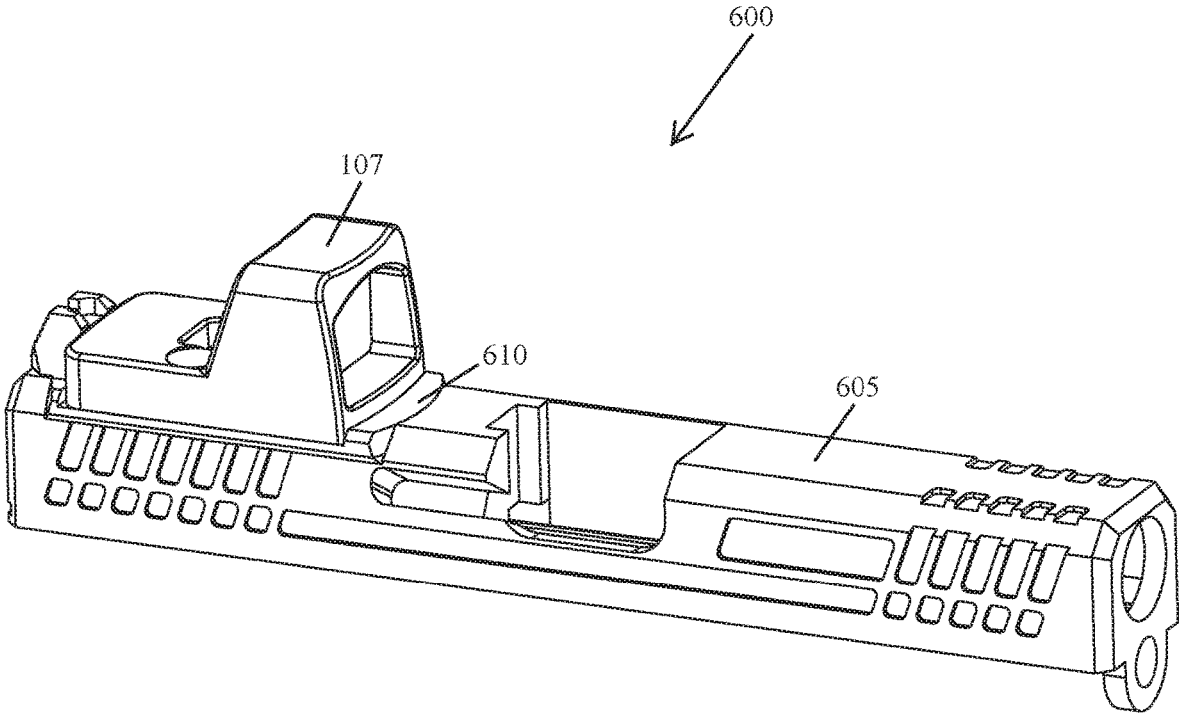
Figure 7A:
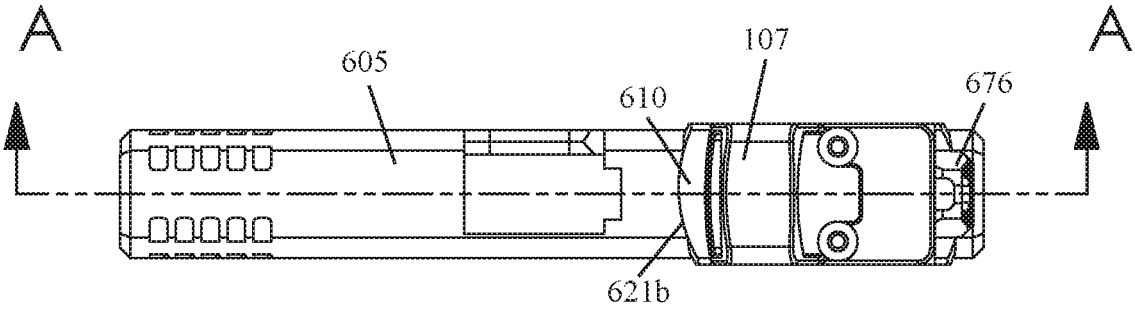
FIG. 7A illustrates a top view of the adapter plate system shown in FIG. 6D, wherein the adapter plate (with an optical sight mounted thereon) is positioned within the adapter interface of the pistol slide.
Figure 7B:
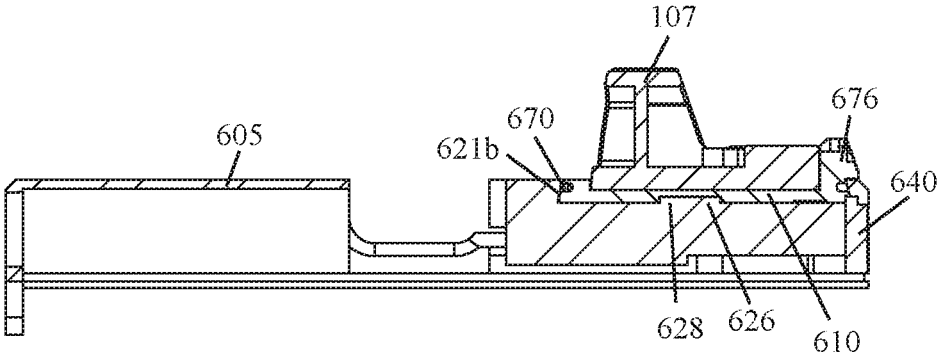
FIG. 7B illustrates a cross-sectional view of the adapter plate system taken along line A-A of FIG. 7A.

In some implementations, the first end 611*a* and/or the second end 611*b* of the adapter plate 610 may include an indexing spring 670 that is nested in a groove 672 (see, e.g., FIGS. 6A, 6B, and 7B). In some implementations, the indexing spring 670 may be positioned so that it can press (or bear) against an adjacent end wall (e.g., the second end wall 621*b*) of the adapter interface 620 (see, e.g., FIG. 7B). In this way, the indexing spring 670 is able to secure the adapter plate 610 against unintentional rotation while it's positioned within the adapter interface 620 (see, e.g., FIG. 6C). In some implementations, the adjacent end wall (e.g., the second end wall 621*b*) of the adapter interface 620 may include a groove therein that is configured to act as a catch for the indexing spring 670. In some implementations, the adapter plate 610 may not include an indexing spring 670 in either the first end 611*a* or the second end 611*b* thereof. Instead, such an implementation may rely solely on the slide cover plate 640 to secure it in position within the adapter interface 620.

Figure 8A:
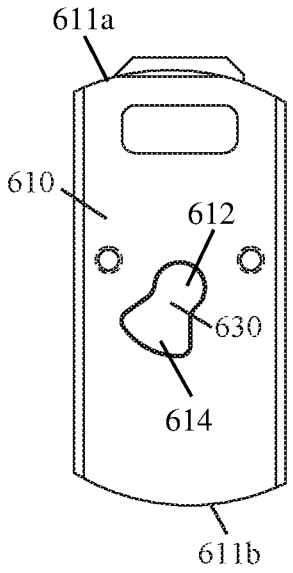
FIGS. 8A and 8B illustrate another example adapter plate according to the principles of the present disclosure.

As shown in FIG. 8A, in some implementations, the underside of the adapter plate 610 is configured to interface with the pivot boss 626 and the rotation stop 628 of the adapter interface 620. In some implementations, the guide feature 630 may comprise a semi-circular pivot bore 612 that has a fan-shaped guide channel 614 extending therefrom (see, e.g., FIG. 8A). In this way, while the pivot boss 626 and the rotation stop 628 of the adapter interface 620 are positioned within the semi-circular pivot bore 612 and the fan-shaped guide channel 614 of the adapter plate 610, respectively, the adapter plate 610 can be rotated into position within the adapter interface 620 (see, e.g., FIG. 7B).

Figure 8B:
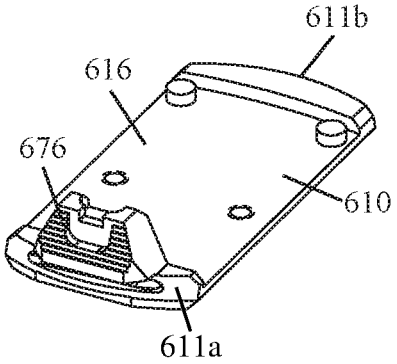

As shown in FIG. 8B, in some implementations, the adapter plate 610 may further comprise a rear sight 676. In some implementations, the rear sight 676 is positioned so that it can be used in conjunction with a front sight (not shown, but well known to those of ordinary skill in the art) mounted on the pistol slide 605 to aim the pistol. In some implementations, the adapter plate 610 may be configured so that the rear sight 676 and a corresponding front sight post can be used to aim the pistol even when an optical sight 107 is secured to the mounting surface 616. In some implementations, the adapter plate 610 may not include a rear sight 676.

In yet another example implementation of an adapter plate system, the adapter plate system may be similar to the adapter plate systems 100, 400, 500, 600 discussed above, in particular the adapter plate system 600 shown in FIGS. 6A-6D and 7A-7B, but a pivot boss with an integrated rotation stop may extend from the underside of the adapter plate; and the guide feature may be located in the bottom surface of the adapter interface. In this way, the adapter interface of the pistol slide may be configured to rotatably receive the adapter plate therein.

While a Glock® model pistol slide is shown in FIGS. 1A-1D, 2A-2B, 4A-4B, 5A-5D, 6A-6D, and 7A-7B, an adapter plate system 100, 400, 500, 600 may be configured to work with other autoloading pistols currently known or developed in the future (e.g., Smith & Wesson® M&P® model pistols and/or Sig Sauer P320® model pistols).

FIGS. 9A-9D illustrate an optical sight mounting system 900 according to the principles of the present disclosure. In some implementations, the optical sight mounting system 900 comprises an optical sight 907 having a base 910 configured to be removably secured to an adapter interface 920 of a pistol slide 905. In this way, the optical sight 907 can be mounted on a pistol and used to aim it. In some implementations, the base 910 of the optical sight 907 and the adapter interface 920 of the pistol slide 905 are similar to the adapter plates 110, 410, 510, 610 and the adapter interfaces 120, 420, 520, 620, respectively, discussed above, in particular the adapter plate 610 shown in FIGS. 8A and 8B and the adapter interface 620 shown in FIGS. 6A, 6B and 7B.

As shown in FIGS. 9A-9D, in some implementations, the optical sight mounting system 900 may comprise an optical sight 907 having a base 910 configured to act as an adapter; and a pistol slide 905 having an adapter interface 920 configured to receive the base 910 of the optical sight 907. In this way, the optical sight 907 can be secured to the adapter interface 920 of the pistol slide 905 without the use of a separate (i.e., discrete) adapter plate.

Figure 9A:
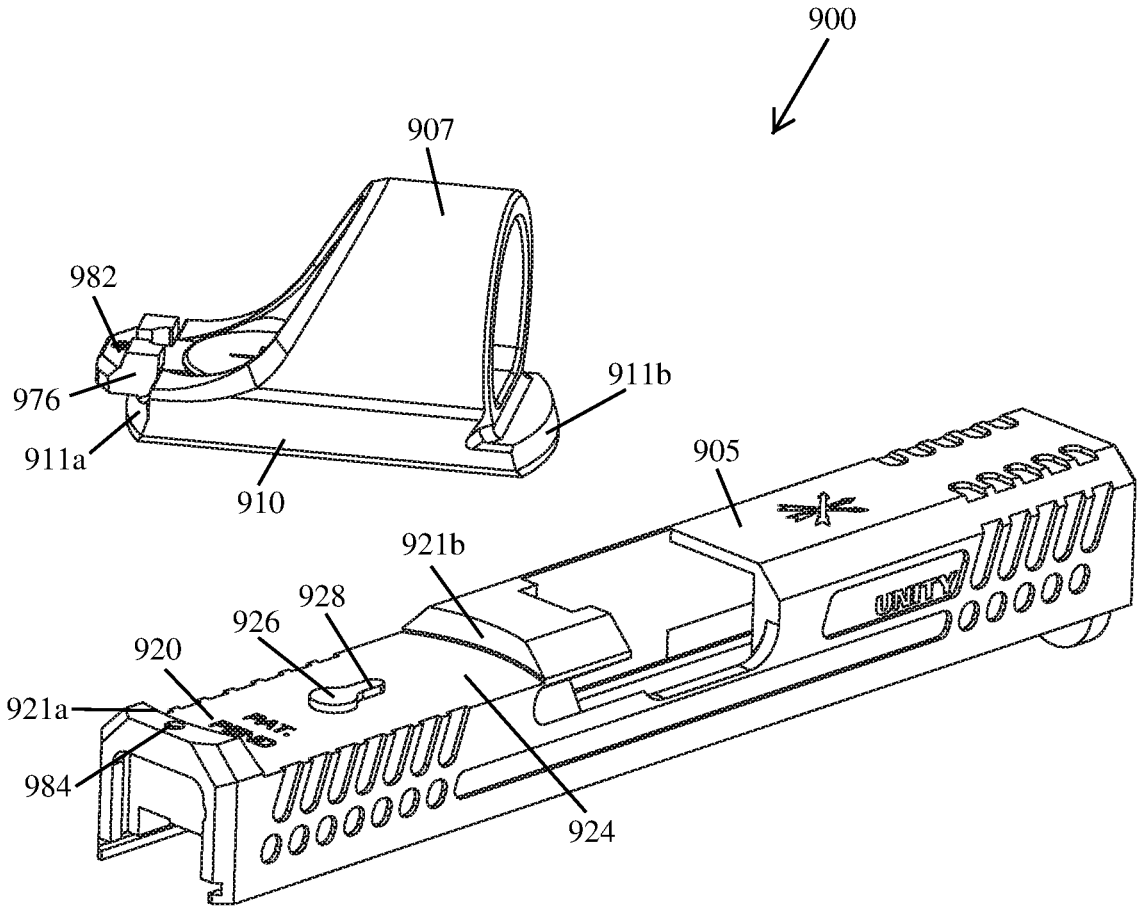
FIGS. 9A-9D illustrate an example optical sight mounting system according to the principles of the present disclosure.

As shown in FIG. 9A, in some implementations, the adapter interface 920 may comprise a bottom surface 924 having a pivot boss 926 and a rotation stop 928 extending therefrom, the bottom surface 924 extends between a first end wall 921*a* and a second end wall 921*b* (collectively end walls 921). The pivot boss 926 and the rotation stop 928 are configured (i.e., keyed) to be received within a guide feature in the underside of the optical sight's base 910. In this way, the base 910 of the optical sight 907 can rotate about the pivot boss 926 while the rotation stop 928 acts as an indexing feature configured to limit the rotation of the base 910 when it is being rotated into position within the adapter interface 920 of the pistol slide 905 (see, e.g., FIGS. 9B-9D). In some implementations, the top side of the first end wall 921*a* includes a detent 984 (or divot) configured to interface with a set screw 980 (discussed in greater detail below).

Figure 9B:
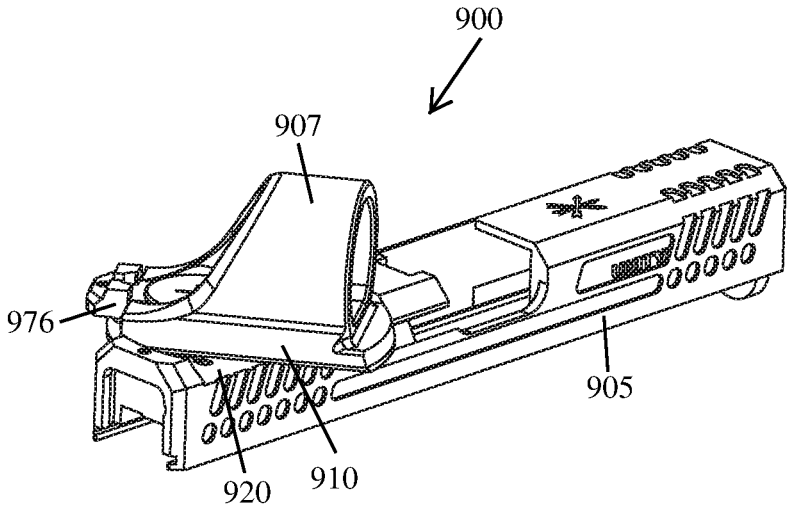
Figure 9C:
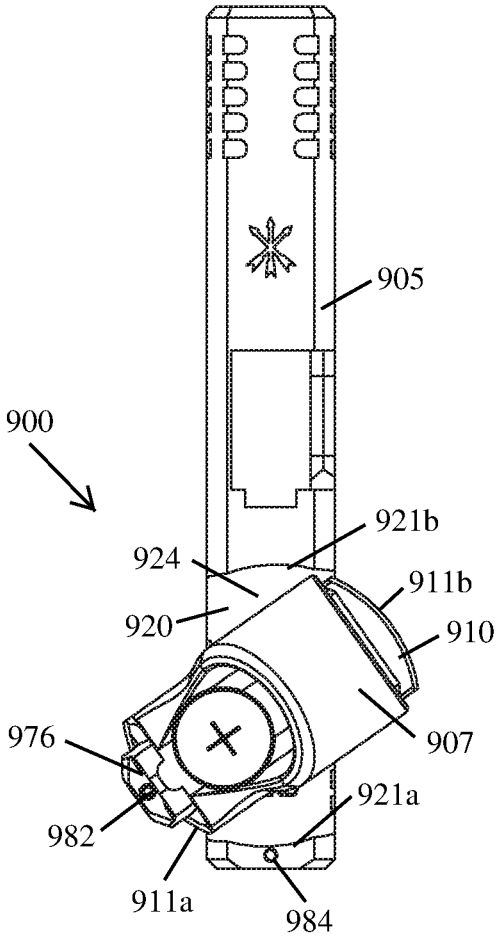

As shown in FIGS. 9A and 9C, in some implementations, the end walls 921*a*, 921*b* of the adapter interface 920 are configured to interface with the curved ends 911*a*, 911*b* of the optical sight's base 910. In some implementations, each end wall 921*a*, 921*b* of the adapter interface 920 may be curved along its length and thereby configured so that the base 910 of the optical sight 907 can be rotated into position within the adapter interface 920 (see, e.g., FIGS. 9B-9D). In some implementations, the first end wall 921*a* and the second end wall 921*b* of the adapter interface 920 each extend from the bottom surface 924 at an angle, thereby forming a dovetail undercut (i.e., the female portion of a curved dovetail joint). The dovetail undercut formed by each end wall 921*a*, 921*b* of the adapter interface 920 is configured to receive a male portion of the rounded dovetail joint found on each end 911*a*, 911*b* of the optical sight's base 910 (see, e.g., FIGS. 9B and 9C). In this way, a secure connection may be achieved when the base 910 of the optical sight 907 is rotated into position within the adapter interface 920 of the pistol slide 905. Since inertial force resulting from the reciprocating movement of the slide 905 is transferred through the rounded dovetail joint formed between the optical sight's base 910 and the adapter interface 920, this design is superior to those that primarily rely on one or more fasteners (e.g., screw(s)) to secure an optical sight to a pistol slide.

In some implementations, the optical sight 907 may have an aiming point illuminated by electricity, tritium, a light emitting chemical reaction, or a combination thereof. A key feature of the optical sight mounting system 900 is an optical sight 907 having an integral base 910 configured to be received by an appropriately configured adapter interface 920. Therefore, in some implementations, the optical sight 907 can be similar to an Aimpoint® Micro optical sight, a DOCTER® red dot sight, a Leupold® Deltapoint, a Trijicon RMR®, or other optical sight of similar size that is currently known or developed in the future, that includes an integral base 910 configured to interface with the adapter interface 920 of the optical sight mounting system 900.

As shown in FIGS. 9A-9D, the base 910 of the optical sight 907 is configured so that it can be rotated into position within the adapter interface 920 of the pistol slide 905. In some implementations, the underside of the optical sight's base 910 is configured to interface with the pivot boss 926 and the rotation stop 928 of the adapter interface 920. In some implementations, the guide feature in the underside of the base 910 may comprise a semi-circular pivot bore that has a fan-shaped guide channel extending therefrom (similar to elements 612, 614, 630 shown in FIG. 8A). In this way, while the pivot boss 926 and the rotation stop 928 of the adapter interface 920 are positioned within the semi-circular pivot bore and the fan-shaped guide channel of the optical sight's base 910, respectively, the optical sight 907 can be rotated into position within the adapter interface 920 (see, e.g., FIGS. 9A-9D).

As shown in FIG. 9A, in some implementations, the base 910 of the optical sight 907 may further comprise a rear sight 976. In some implementations, the rear sight 976 is positioned so that it can be used in conjunction with a front sight (not shown, but well known to those of ordinary skill in the art) mounted on the pistol slide 905 to aim the pistol. In some implementations, the base 910 of the optical sight 907 may not include a rear sight 976.

As shown in FIGS. 9A-9D, in some implementations, the optical sight base 910 may include a threaded opening 982 that extends therethrough. Once the optical sight 907 has been rotated into position within the adapter interface 920, this opening 982 aligns with the detent 984 (or divot) on the top side of the pistol slide 905. In this way, a set screw 980 can be used to further secure the optical sight 907 in position within the adapter interface 920.

As shown in FIGS. 9A-9D, in some implementations, the following steps may be used to secure the optical sight 907 to the adapter interface 920 of the pistol slide 905.

Initially, as shown in FIG. 9A, the optical sight 907 is positioned at an offset angle (e.g., 60 degrees) relative to the longitudinal axis of the pistol slide 905 so that the pivot boss 926 and the rotation stop 928 are received within the pivot bore and the guide channel, respectively, in the underside of the base 910. The degree of offset required to begin installation of the adapter plate 910 is, at least in part, a function of the guide channel's 914 configuration (e.g., length, position, etc).

Then, as shown in FIGS. 9B and 9C, the optical sight 907 is rotated about the pivot boss 926 until rotation is stopped by the rotation stop 928. The optical sight 907 will now be aligned with the longitudinal axis of the pistol slide 905 (see, e.g., FIG. 9D).

Figure 9D:
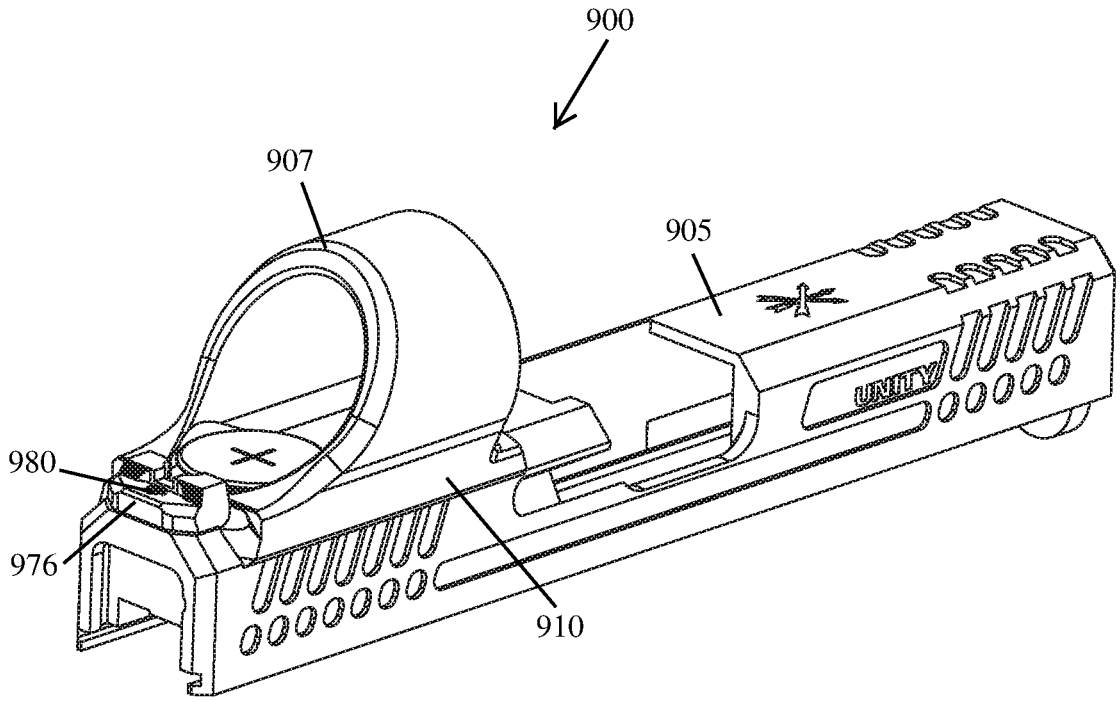

Next, in some implementations, as shown in FIG. 9D, a set screw 980 is used to further secure the base 910 of the optical sight 907 to the slide 905. In some implementations, the set screw 980 is threaded into the opening 982 of the base 910 until the tip projects from the opening 982 into a detent 984 (or divot) found on the slide 905, thereby securing the optical sight 907 in position within the adapter interface 920. The tip of the set screw 980 is nested in the detent 984.

To remove the optical sight 910 from the adapter interface 920, the above steps are performed in reverse.

While a Glock® model pistol slide 905 is shown in FIGS. 9A-9D, an optical sight mounting system 900 may be configured to work with other autoloading pistols currently known or developed in the future (e.g., Smith & Wesson® M&P® model pistols, Sig Sauer P320® model pistols, etc.).

Figure 10A:
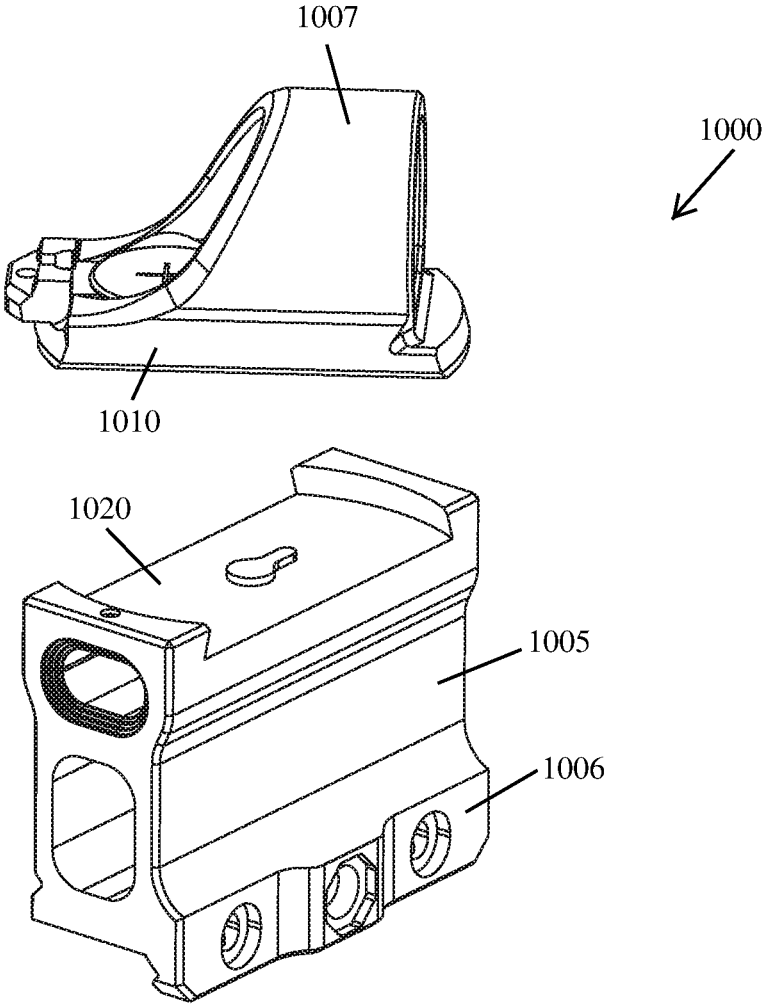
FIGS. 10A-10C illustrate another example optical sight mounting system according to the principles of the present disclosure.
Figure 10B:
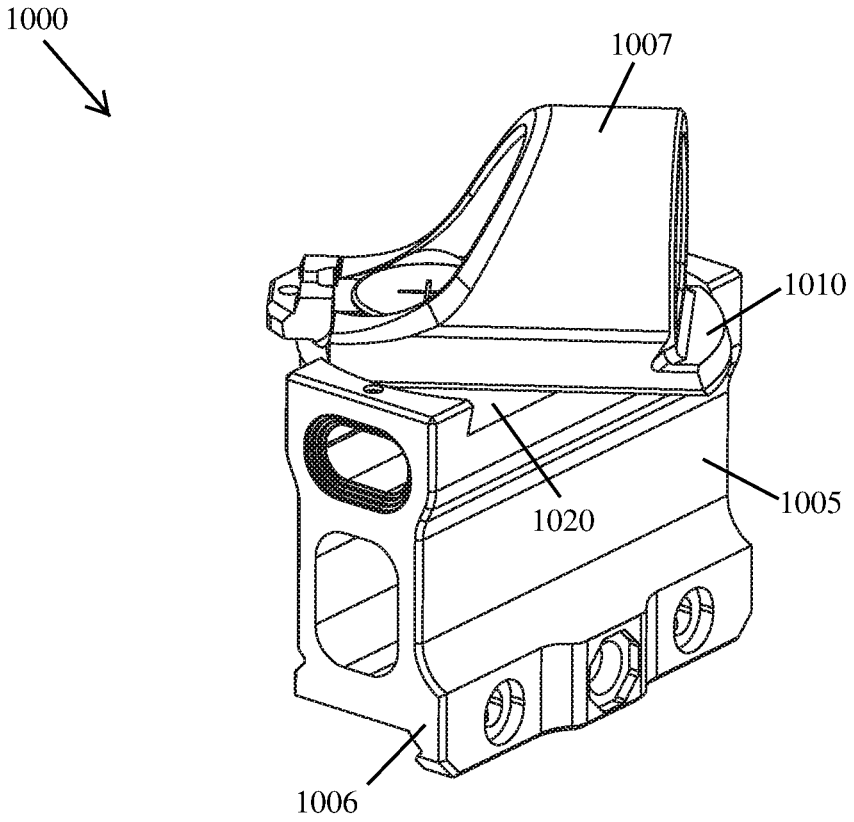
Figure 10C:
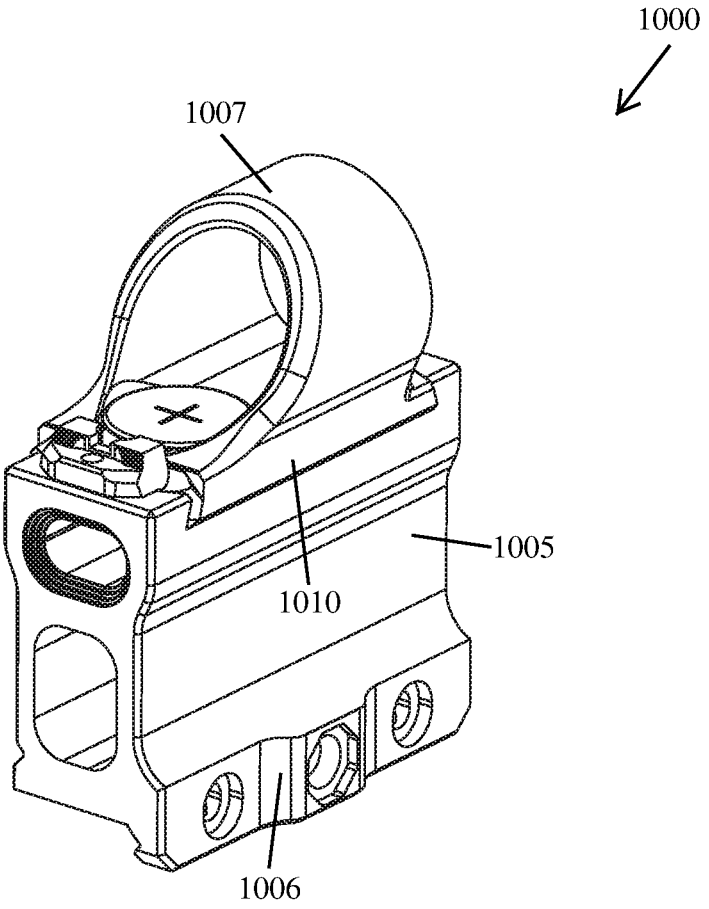

FIGS. 10A-10C illustrate another example implementation of optical sight mounting system 1000 according to the principles of the present disclosure. In some implementations, the optical sight mounting system 1000 is similar to the optical sight mounting system 900 discussed above, but the adapter interface 1020 has been incorporated onto an optical sight mount 1005 configured to be secured to, or removed from, a mounting interface of a firearm (e.g., a MIL-STD-1913 rail). In this way, the optical sight 1007 can be positioned on a firearm (e.g., a rifle) and used to aim it.

In some implementations, the optical sight mounting system 1000 comprises an optical sight 1007 having a base 1010 configured to be removably secured to an adapter interface 1020 of an optical sight mount 1005. In this way, the optical sight 1007 can be mounted on a firearm (e.g., a rifle) and used to aim it. The base 1010 of the optical sight 1007 is configured so that it can be rotated into position within the adapter interface 1020 of the optical sight mount 1005.

As shown in FIGS. 10A-10C, in some implementations, the optical sight mount 1005 may comprise a base 1006 configured to be secured to, or removed from, a mounting interface of a firearm (e.g., a MIL-STD-1913 rail); and an adapter interface 1020 configured to receive the base 1010 of an optical sight 1007. Except as noted herein, in some implementations, an optical sight mount 1005 may be the same as, or similar to, an optical sight mount described in U.S. patent application Ser. No. 16/375,906, filed on Apr. 5, 2019, entitled "MOUNTS FOR OPTICAL SIGHTING DEVICES", by Trent Zimmer (hereinafter, "the Zimmer application"), which is also owned by the applicant of the present application and is hereby expressly incorporated by reference as if fully set forth herein.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An optical sight mounting system for a pistol, the optical sight mounting system comprising:

a pistol slide, the pistol slide includes an adapter interface, the adapter interface comprises a bottom surface that extends between a first end wall and a second end wall, the adapter interface includes a pivot boss that extends up from the bottom surface thereof; and an optical sight, the optical sight includes a base that can be secured to the adapter interface of the pistol slide, the base of the optical sight comprises a pivot bore in an underside thereof, the pivot bore of the base is configured to receive the pivot boss of the adapter interface therein;

wherein the base of the optical sight is configured so that it can be rotated into position within the adapter interface of the pistol slide.

2. The optical sight mounting system of claim 1, wherein the adapter interface also includes a rotation stop that extends up from the bottom surface thereof; the base of the optical sight further comprises a curved guide channel in the underside thereof, the curved guide channel of the base is configured to receive the rotation stop of the adapter interface therein.

3. The optical sight mounting system of claim 1, wherein each end of the base of the optical sight is curved; the first end wall and the second end wall of the adapter interface are configured so that the base of the optical sight can be rotated into position within the adapter interface.

4. The optical sight mounting system of claim 1, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

5. The optical sight mounting system of claim 1, further comprising a slide cover plate, the slide cover plate is configured to interface with a first end of the base of the optical sight and thereby prevent the optical sight from rotating while positioned within the adapter interface.

6. The optical sight mounting system of claim 5, wherein the first end wall of the adapter interface includes a slot that extends therethrough; a lip of the slide cover plate extends into the slot and interfaces with the first end of the base of the optical sight.

7. The optical sight mounting system of claim 1, further comprising a set screw, the set screw can be used to further secure the base of the optical sight in position within the adapter interface.

8. The optical sight mounting system of claim 7, wherein a top side of the pistol slide includes a divot that-is configured to receive a portion of the set screw therein; the base of the optical sight includes a threaded opening that extends therethrough, the threaded opening aligns with the divot on the pistol slide while the base of the optical sight is positioned within the adapter interface; the set screw is positioned within the threaded opening of the base of the optical sight so that an end thereof is positioned within the divot of the pistol slide.

9. An optical sight mounting system for a pistol, the optical sight mounting system comprising:

a pistol slide, the pistol slide includes an adapter interface, the adapter interface comprises a bottom surface that extends between a first end wall and a second end wall, the adapter interface includes a pivot boss and a rotation stop that are a single unitary piece; and an optical sight, the optical sight includes a base configured so that it can be rotated into position between the first end wall and the second end wall of the adapter interface, the base of the optical sight comprises a guide feature in an underside thereof, the guide feature is configured to interface with the pivot boss and the rotation stop of the adapter interface.

10. The optical sight mounting system of claim 9, wherein the guide feature in the underside of the base of the optical sight comprises a semi-circular pivot bore that has a fan-shaped guide channel extending therefrom.

11. An optical sight mounting system for a firearm, the optical sight mounting system comprising:

an optical sight mount, the optical sight mount comprises a base and an adapter interface, the base of the optical sight mount is configured to releasably engage a mounting interface of a firearm, the adapter interface comprises a bottom surface that extends between a first end wall and a second end wall, the adapter interface includes a pivot boss and a rotation stop that are a single unitary piece; and an optical sight, the optical sight includes a base that can be secured to the adapter interface of the optical sight mount, the base of the optical sight comprises a guide feature in an underside thereof, the guide feature is configured to interface with the pivot boss and the rotation stop of the adapter interface;

wherein the base of the optical sight is configured so that it can be rotated into position within the adapter interface of the optical sight mount.

12. The optical sight mounting system of claim 11, wherein the guide feature in the underside of the base of the optical sight comprises a semi-circular pivot bore that has a fan-shaped guide channel extending therefrom.

13. An optical sight mounting system for a pistol, the optical sight mounting system comprising:

a pistol slide, the pistol slide includes an adapter interface, the adapter interface comprises a bottom surface that extends between a first end wall and a second end wall, the adapter interface includes a pivot bore in the bottom surface thereof; and an optical sight, the optical sight includes a base that can be secured to the adapter interface of the pistol slide, the base of the optical sight comprises a pivot boss that extends from an underside thereof;

wherein the pivot bore of the adapter interface is configured to receive the pivot boss of the base therein;

wherein the base of the optical sight is configured so that it can be rotated into position within the adapter interface of the pistol slide.

14. The optical sight mounting system of claim 13, wherein the adapter interface also includes a curved guide channel in the bottom surface thereof; the base of the optical sight further comprises a rotation stop that extends from the underside thereof; the curved guide channel of the adapter interface is configured to receive the rotation stop of the base therein.

15. The optical sight mounting system of claim 13, wherein each end of the base of the optical sight is curved; the first end wall and the second end wall of the adapter interface are configured so that the base of the optical sight can be rotated into position within the adapter interface.

16. The optical sight mounting system of claim 13, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

17. The optical sight mounting system of claim 13, further comprising a slide cover plate, the slide cover plate is configured to interface with a first end of the base of the optical sight and thereby prevent the optical sight from rotating while positioned within the adapter interface.

18. The optical sight mounting system of claim 17, wherein the first end wall of the adapter interface includes a slot that extends therethrough; a lip of the slide cover plate extends into the slot and interfaces with the first end of the base of the optical sight.

19. The optical sight mounting system of claim 13, further comprising a set screw, the set screw can be used to further secure the base of the optical sight in position within the adapter interface.

20. The optical sight mounting system of claim 19, wherein a top side of the pistol slide includes a divot configured to receive a portion of the set screw therein; the base of the optical sight includes a threaded opening that extends therethrough, the threaded opening aligns with the divot on the pistol slide while the base of the optical sight is positioned within the adapter interface; the set screw is positioned within the threaded opening of the base of the optical sight so that an end thereof is positioned within the divot of the pistol slide.

21. The optical sight mounting system of claim 9, wherein each end of the base of the optical sight is curved; the first end wall and the second end wall of the adapter interface are configured so that the base of the optical sight can be rotated into position within the adapter interface.

22. The optical sight mounting system of claim 9, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

23. The optical sight mounting system of claim 9, further comprising a slide cover plate, the slide cover plate is configured to interface with a first end of the base of the optical sight and thereby prevent the optical sight from rotating while positioned within the adapter interface.

24. The optical sight mounting system of claim 23, wherein the first end wall of the adapter interface includes a slot that extends therethrough; a lip of the slide cover plate extends into the slot and interfaces with the first end of the base of the optical sight.

25. The optical sight mounting system of claim 9, further comprising a set screw, the set screw can be used to further secure the base of the optical sight in position within the adapter interface.

26. The optical sight mounting system of claim 25, wherein a top side of the pistol slide includes a divot configured to receive a portion of the set screw therein; the base of the optical sight includes a threaded opening that extends therethrough, the threaded opening aligns with the divot on the pistol slide while the base of the optical sight is positioned within the adapter interface; the set screw is positioned within the threaded opening of the base of the optical sight so that an end thereof is positioned within the divot of the pistol slide.

27. An optical sight mounting system for a pistol, the optical sight mounting system comprising:

a pistol slide, the pistol slide includes an adapter interface, the adapter interface comprises a bottom surface that extends between a first end wall and a second end wall, the adapter interface includes a guide feature in the bottom surface thereof; and an optical sight, the optical sight includes a base configured so that it can be rotated into position between the first end wall and the second end wall of the adapter interface, the base of the optical sight comprises a pivot boss and a rotation stop that are a single unitary piece extending from an underside thereof;

wherein the guide feature of the adapter interface is configured to interface with the pivot boss and the rotation stop of the base.

28. The optical sight mounting system of claim 27, wherein the guide feature in the bottom surface of the adapter interface comprises a semi-circular pivot bore that has a fan-shaped guide channel extending therefrom.

29. The optical sight mounting system of claim 27, wherein each end of the base of the optical sight is curved; the first end wall and the second end wall of the adapter interface are configured so that the base of the optical sight can be rotated into position within the adapter interface.

30. The optical sight mounting system of claim 27, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

31. The optical sight mounting system of claim 27, further comprising a slide cover plate, the slide cover plate is configured to interface with a first end of the base of the optical sight and thereby prevent the optical sight from rotating while positioned within the adapter interface.

32. The optical sight mounting system of claim 31, wherein the first end wall of the adapter interface includes a slot that extends therethrough; a lip of the slide cover plate extends into the slot and interfaces with the first end of the base of the optical sight.

33. The optical sight mounting system of claim 27, further comprising a set screw, the set screw can be used to further secure the base of the optical sight in position within the adapter interface.

34. The optical sight mounting system of claim 33, wherein a top side of the pistol slide includes a divot configured to receive a portion of the set screw therein; the base of the optical sight includes a threaded opening that extends therethrough, the threaded opening aligns with the divot on the pistol slide while the base of the optical sight is positioned within the adapter interface; the set screw is positioned within the threaded opening of the base of the optical sight so that an end thereof is positioned within the divot of the pistol slide.

35. The optical sight mounting system of claim 11, wherein each end of the base of the optical sight is curved; the first end wall and the second end wall of the adapter interface are configured so that the base of the optical sight can be rotated into position within the adapter interface.

36. The optical sight mounting system of claim 11, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

37. The optical sight mounting system of claim 11, further comprising a set screw, the set screw can be used to further secure the base of the optical sight in position within the adapter interface.

38. The optical sight mounting system of claim 37, wherein a top side of the optical sight mount includes a divot configured to receive a portion of the set screw therein; the base of the optical sight includes a threaded opening that extends therethrough, the threaded opening aligns with the divot on the optical sight mount while the base of the optical sight is positioned within the adapter interface; the set screw is positioned within the threaded opening of the base of the optical sight so that an end thereof is positioned within the divot of the optical sight mount.

39. An optical sight mounting system for a firearm, the optical sight mounting system comprising:

an optical sight mount, the optical sight mount comprises a base and an adapter interface, the base of the optical sight mount is configured to releasably engage a mounting interface of a firearm, the adapter interface comprises a bottom surface that extends between a first end wall and a second end wall, the adapter interface includes a guide feature in the bottom surface thereof; and an optical sight, the optical sight includes a base that can be secured to the adapter interface of the optical sight mount, the base of the optical sight comprises a pivot boss and a rotation stop that are a single unitary piece extending from an underside thereof;

wherein the guide feature of the adapter interface is configured to interface with the pivot boss and the rotation stop of the base of the optical sight;

wherein the base of the optical sight is configured so that it can be rotated into position within the adapter interface of the optical sight mount.

40. The optical sight mounting system of claim 39, wherein the guide feature in the bottom surface of the adapter interface comprises a semi-circular pivot bore that has a fan-shaped guide channel extending therefrom.

41. The optical sight mounting system of claim 39, wherein each end of the base of the optical sight is curved; the first end wall and the second end wall of the adapter interface are configured so that the base of the optical sight can be rotated into position within the adapter interface.

42. The optical sight mounting system of claim 39, wherein one end of the base of the optical sight includes an indexing spring that is nested in a groove, the indexing spring is configured to press against the first end wall or the second end wall of the adapter interface and thereby secure the optical sight against unintentional rotation while it is positioned within the adapter interface.

43. The optical sight mounting system of claim 39, further comprising a set screw, the set screw can be used to further secure the base of the optical sight in position within the adapter interface.

44. The optical sight mounting system of claim 43, wherein a top side of the optical sight mount includes a divot configured to receive a portion of the set screw therein; the base of the optical sight includes a threaded opening that extends therethrough, the threaded opening aligns with the divot on the optical sight mount while the base of the optical sight is positioned within the adapter interface; the set screw is positioned within the threaded opening of the base of the optical sight so that an end thereof is positioned within the divot of the optical sight mount.

* * * * *